US011603987B2

(12) United States Patent
Levi et al.

(10) Patent No.: US 11,603,987 B2
(45) Date of Patent: Mar. 14, 2023

(54) LIGHTING SYSTEM FOR FIXTURES AND APPLIANCES

(71) Applicant: Kraus USA Plumbing LLC, Port Washington, NY (US)

(72) Inventors: Russell Levi, Port Washington, NY (US); Serhiy Torak, Brooklyn, NY (US)

(73) Assignee: Kraus USA Plumbing LLC, Port Washington, NY (US)

( * ) Notice: Subject to any disclaimer, the term of this patent is extended or adjusted under 35 U.S.C. 154(b) by 57 days.

(21) Appl. No.: 17/006,992

(22) Filed: Aug. 31, 2020

(65) Prior Publication Data

US 2022/0065436 A1 Mar. 3, 2022

(51) Int. Cl.

| | |
|---|---|
| ***F21V 33/00*** | (2006.01) |
| ***F21V 23/00*** | (2015.01) |
| ***F21V 17/10*** | (2006.01) |
| ***H05B 47/19*** | (2020.01) |
| ***F21V 17/06*** | (2006.01) |
| ***E03C 1/186*** | (2019.01) |
| *A47K 1/04* | (2006.01) |
| *F21W 131/30* | (2006.01) |

(52) U.S. Cl.

CPC ..... *F21V 33/004* (2013.01); *E03C 1/186* (2013.01); *F21V 17/06* (2013.01); *F21V 17/101* (2013.01); *F21V 23/003* (2013.01); *H05B 47/19* (2020.01); *A47K 1/04* (2013.01); *F21W 2131/30* (2013.01)

(58) Field of Classification Search

CPC ..... F21V 33/004; F21V 17/06; F21V 17/101; F21V 23/003; F21V 2131/30; H05B 47/19; A47K 1/04; E03C 1/186

See application file for complete search history.

(56) References Cited

U.S. PATENT DOCUMENTS

| | | | |
|---|---|---|---|
| 4,012,630 | A | 3/1977 | Gareis |
| 4,241,868 | A | 12/1980 | Perkins |
| 4,623,451 | A | 11/1986 | Oliver |
| 4,749,126 | A | 6/1988 | Kessener et al. |
| 4,998,673 | A | 3/1991 | Pilolla |
| 5,195,819 | A | 3/1993 | Chaut et al. |
| 5,217,292 | A | 6/1993 | Chalberg |
| 5,491,617 | A | 2/1996 | Currie |
| 5,708,749 | A | 1/1998 | Kacheria |
| 5,799,124 | A | 8/1998 | Zorn et al. |
| 6,126,290 | A | 10/2000 | Veigel |

(Continued)

FOREIGN PATENT DOCUMENTS

| | | | |
|---|---|---|---|
| CN | 201228378 | U | 4/2009 |
| CN | 201875209 | U | 6/2011 |

(Continued)

*Primary Examiner* — Zheng Song

(74) *Attorney, Agent, or Firm* — Bose McKinney & Evans LLP

(57) ABSTRACT

A lighting system for fixtures comprising a removable façade configured to connect or being prior mounted or fabricated with a fixture, the removable façade including an outermost apron, a translucent panel including at least one opening, a sheet panel having at least one reinforcement element, and at least one light source disposed therein, wherein the apron includes at least one opening disposed thereon, and wherein the at least one light source is configured to emit light thought the at least one.

15 Claims, 2 Drawing Sheets

(56) References Cited

U.S. PATENT DOCUMENTS 6,154,895 A * 12/2000 Pisklak ..... E03C 1/18 4/584
6,439,472 B1 8/2002 Lin et al.
6,467,103 B1 10/2002 Gardenier et al.
6,539,561 B2 4/2003 Shimizu
6,601,247 B2 8/2003 Shimizu
6,637,676 B2 10/2003 Zieger et al.
6,805,458 B2 10/2004 Schindler et al.
6,877,171 B2 4/2005 Shimizu
6,886,958 B1 5/2005 Grant
6,936,978 B2 8/2005 Morgan et al.
6,942,354 B2 9/2005 Metayer et al.
6,996,863 B2 2/2006 Kaneko
7,228,574 B2 6/2007 Hansen et al.
7,228,874 B2 6/2007 Bolderheij et al.
7,303,299 B2 12/2007 Theus
7,303,300 B2 12/2007 Dowling et al.
7,377,661 B2 5/2008 Douglass
7,406,722 B2 8/2008 Fukuizumi et al.
7,434,960 B2 10/2008 Stuhlmacher, II et al.
7,467,874 B2 12/2008 Gautschi et al.
7,482,764 B2 1/2009 Morgan et al.
7,500,443 B1 3/2009 Allen
7,553,076 B2 6/2009 An
7,743,788 B2 6/2010 Schmitt et al.
7,806,549 B2 10/2010 Beaulieu
7,819,541 B2 10/2010 Kunkel
7,931,382 B2 4/2011 Hecht
8,011,604 B1 9/2011 Holtsnider et al.
8,096,678 B2 1/2012 Jones, III et al.
8,156,580 B1 * 4/2012 Paone ..... E03C 1/186 4/654
8,277,070 B1 * 10/2012 Schwarz ..... F21V 33/0012 362/133
8,318,273 B2 11/2012 Lai
8,337,033 B2 12/2012 Kaneda et al.
8,360,590 B2 1/2013 Carter
8,365,767 B2 2/2013 Davidson et al.
8,479,765 B1 7/2013 Wren
8,572,772 B2 11/2013 Wolf et al.
8,818,500 B2 8/2014 Duquet et al.
8,950,730 B2 2/2015 Bedolla et al.
9,057,184 B2 6/2015 Meehan et al.
9,062,839 B1 6/2015 Elder
9,068,327 B2 6/2015 Granstrand
9,157,219 B2 10/2015 Gibson
9,333,698 B2 5/2016 DeVries et al.
9,429,246 B2 8/2016 Chen et al.
9,464,771 B1 * 10/2016 Anderson ..... F21V 21/00
9,488,341 B2 11/2016 Nauen
9,534,778 B1 1/2017 Donley, Jr.
9,560,781 B2 1/2017 Kothandapani et al.
9,719,667 B2 8/2017 Drury et al.
D804,620 S 12/2017 Palazzolo et al.
9,958,586 B2 5/2018 Kosarnig
10,041,236 B2 8/2018 Loberger et al.
10,076,216 B2 9/2018 Yang et al.
10,077,194 B2 9/2018 Knight et al.
10,101,521 B1 10/2018 Burgio, Jr.
10,125,901 B2 11/2018 Davidson et al.
10,151,085 B2 12/2018 Chong et al.
10,178,928 B2 1/2019 Ophardt et al.
D865,138 S 10/2019 Lyons
10,458,642 B2 10/2019 Heuer et al.
D872,243 S 1/2020 Wegner et al.
11,149,421 B2 * 10/2021 Liang ..... A47B 77/06
2003/0019028 A1 * 1/2003 Shimizu ..... F21V 33/004 4/541.5
2005/0047143 A1 3/2005 Currie
2005/0223486 A1 * 10/2005 Jumalon ..... A47B 77/06 4/619
2006/0133065 A1 * 6/2006 Douglass ..... E03C 1/14 362/101
2009/0065079 A1 3/2009 Chung
2009/0094740 A1 4/2009 Ji
2009/0094741 A1 4/2009 Valadez et al.
2009/0154524 A1 6/2009 Girelli
2009/0289577 A1 11/2009 Thursfield et al.
2010/0148971 A1 6/2010 Wawrla et al.
2010/0254125 A1 * 10/2010 Jones, III ..... E03C 1/186 362/227
2011/0005619 A1 1/2011 Kanemaru et al.
2011/0209781 A1 9/2011 Fath
2012/0162973 A1 6/2012 Carter
2012/0297534 A1 11/2012 Itazu et al.
2013/0025045 A1 1/2013 Gagnon et al.
2014/0104813 A1 4/2014 Donahue
2014/0259376 A1 9/2014 Turner
2015/0033469 A1 2/2015 Ferrante
2015/0202633 A1 7/2015 Perkins
2015/0292693 A1 10/2015 Franke
2015/0345736 A1 * 12/2015 Colacilli ..... F21V 5/048 362/6
2015/0354185 A1 12/2015 Tseng et al.
2015/0354186 A1 12/2015 Tseng et al.
2015/0369471 A1 12/2015 Williams
2018/0187400 A1 * 7/2018 Chong ..... E03C 1/18
2018/0187403 A1 * 7/2018 Chong ..... E03C 1/18
2019/0191874 A1 6/2019 Booth et al.
2020/0063412 A1 * 2/2020 Miller ..... E03C 1/18
2020/0124272 A1 * 4/2020 Spencer ..... G02B 6/0018
2020/0199858 A1 * 6/2020 Eilmus ..... E03C 1/182
2020/0407957 A1 * 12/2020 Vaught ..... E03C 1/14
2021/0404643 A1 * 12/2021 Eilmus ..... E03C 1/182

FOREIGN PATENT DOCUMENTS

CN 103994276 A 8/2014
CN 203857124 U 10/2014
CN 209270177 U 8/2019
CN 210241278 U 4/2020
DE 3135861 C2 6/1989
DE 20017254 U1 3/2001
DE 20102857 U1 5/2001
DE 10219171 A1 11/2003
DE 202004018959 U1 3/2005
DE 102004017736 B3 9/2005
DE 102006052403 A1 4/2008
DE 202008003087 U1 8/2008
DE 102006021701 B4 8/2009
DE 202017006740 U1 4/2018
DE 102017119978 B4 1/2020
EP 0461349 A1 12/1991
EP 0961067 B1 2/2005
EP 1673574 B1 8/2007
EP 1900882 A2 3/2008
EP 1703024 B1 9/2008
EP 2128348 A2 12/2009
EP 2148015 B1 8/2013
EP 3670768 * 12/2019 ..... E03C 1/186
GB 2393389 A 3/2004
JP 2000336709 A 12/2000
JP 2001040891 A 2/2001
JP 2001112855 A 4/2001
JP 2001123485 A 5/2001
JP 2002242246 A 8/2002
JP 2002266393 A 9/2002
JP 2002294775 A 10/2002
JP 2004218335 A 8/2004
JP 2004239615 A 8/2004
JP 2005342179 A 12/2005
JP 2006043419 A 2/2006
JP 2006061634 A 3/2006
JP 2006144331 A 6/2006
JP 2007000308 A 1/2007
JP 2007125194 A 5/2007
JP 2007291606 A 11/2007
JP 2009293264 A 12/2009
JP 2010007425 A 1/2010
JP 2010172468 A 8/2010
JP 2010200980 A 9/2010
JP 2010218956 A 9/2010
JP 2011137293 A 7/2011

(56) References Cited

FOREIGN PATENT DOCUMENTS

| | | | |
|---|---|---|---|
| JP | 5213259 | B2 | 6/2013 |
| JP | 2013185308 | A | 9/2013 |
| JP | 2013212362 | A | 10/2013 |
| KR | 20010099362 | A | 11/2001 |
| KR | 100493202 | B1 | 6/2005 |
| KR | 101301299 | B1 | 8/2013 |
| KR | 101654719 | B1 | 9/2016 |
| KR | 101866262 | B1 | 6/2018 |
| KR | 101949327 | B1 | 2/2019 |
| WO | 0134917 | A1 | 5/2001 |
| WO | 0173227 | A1 | 10/2001 |
| WO | 2004018935 | A1 | 3/2004 |
| WO | 2013023663 | A1 | 2/2013 |
| WO | 2017200374 | A1 | 11/2017 |
| WO | 2019045359 | A1 | 3/2019 |
| WO | 2019078627 | A1 | 4/2019 |

* cited by examiner

LIGHTING SYSTEM FOR FIXTURES AND APPLIANCES

TECHNICAL FIELD

The present disclosure relates to devices and methods configured to illuminate fixtures, such as washbowls, hand basins, or the like. For example, the present disclosure relates to lighting systems or assemblies, which can be operably connected to kitchen or bathroom sinks.

BACKGROUND

Most kitchen, both residential and commercial, are generally equipped with appliances and fixtures such as sinks, refrigerators, vent hoods, dishwashers, stoves and ovens, etc. Bathrooms and kitchens, both private-household and commercial, are also generally equipped with fixtures and washing stations. Kitchens and bathrooms typically require sufficient lighting to perform everyday tasks.

Many sinks are installed inside or adjacent to a countertop which is generally used as a surface for preparation of food; in addition, kitchens are generally equipped with other kitchen features such as cabinets which can be used to store utensils. Some of those utensils may be considered somewhat dangerous articles. Some of those utensils are knives, scissors, fire sources, can openers, razors or blades, and the like. Most of these utensils are considered general elements which are present in an average kitchen, and sometimes bathrooms (with the exception of knives and can openers). Thus, a sufficient light source is necessary when using such dangerous articles or to navigate a poor illuminated space. Therefore, there is a need for lighting systems which can be configured to provide good illumination in kitchens and bathrooms, sufficiently and efficiently. Moreover, there is a need for lighting systems which may reduce the danger for a user when using utensils as the ones noted above by providing good illumination, or just for the sake of navigating the space during the night. Lighting is also important for aesthetic or decorative reasons. Thus, a sufficient, light source is an essential item in a kitchen or bathroom either to enhance illumination of the space, as a safety feature, or for decor. However, most of the lighting fixtures are generally mounted to the ceiling, with some of them, out of reach. Most of these lighting fixtures are inefficient, consuming too much power or providing poor. Thus, there is a need for lighting systems directed to solving the problems and deficiencies of poor illuminated kitchens and bathrooms.

SUMMARY

The present disclosure includes an innovative lighting system for kitchen or bathroom fixtures or appliances which are operably connected to or built in as one unit with a sink or other fixture or appliance.

The lighting system for kitchen or bathroom fixtures may be incorporated into the apron portion of a sink or washing basin.

In aspects the lighting system includes a removable façade configured for connecting to a fixture, the removable façade including, an outermost apron, a translucent panel including at least one opening, a sheet panel having at least one reinforcement element, and at least one light source disposed therebetween.

In other aspects, the apron includes at least one opening with at least one light source configured to emit light thought the at least one opening.

In more aspects, the at least one light source is an LED strip configured to emit light which can pass through the translucent panel.

In some aspects, the light source is connected to the sheet panel.

In aspects, an LED strip is connected to an L-fold and is configured to emit light in a direction downward.

In aspects, the sheet panel can be an L-folded sheet panel wherein one side includes an L-fold.

In other aspects, the outer apron can include an elongate C-shape correctional profile.

In further aspects, a pair of C-profiles can be operably connected to the sheet panel and substantially rectangular reinforcements connected to the pair of C-profiles.

In aspects, the sheet panel can slide relative to the C-profiles.

Still in aspects, the fixture can be a sink.

In other aspects, a method for illuminating a fixture includes providing an apron having at least one opening configured to enable passing of illumination coming from an interior lighting fixture, connecting a translucent panel to the apron configured to enable passing of illumination coming from an interior lighting fixture, connecting a light source to a sheet panel, connecting the apron and the sheet panel in such a way that the light source is disposed between the plastic panel and the metal sheet panel, and powering the light source to enable passing of light through the at least one opening.

In aspects, the method can include connecting the sheet metal or the apron to a sink.

In further aspects, the lighting system may include a mounting element configured to operably connect the smart apron onto a sink, a lighting feature configured to operably connect to the mounting element and to emit light, a substrate configured to diffuse the emitted light and to operably connect to the mounting element sandwiching the lighting feature between the substrate and the mounting element, and a façade having at least one opening disposed about the lighting feature in such a way that the opening enables passing of the light diffused by the substrate to the exterior of the façade.

Still in further aspects, the lighting feature can be a programmable LED light connected to a receiver and the receiver can be connected to a mobile device or remote control via WIFI or Bluetooth protocols.

In other further aspects, the remote control can be an LED remote control or an RGB LED light strip with additional voice controlling options that may enable color changing or turning on or off of the LED light.

BRIEF DESCRIPTION OF THE DRAWINGS

The accompanying drawings, which are incorporated in and constitute a part of this specification, illustrate embodiments of the disclosure and, together with a general description of the disclosure given above, and the detailed description of the embodiments given below, serve to explain the principles of the disclosure, wherein.

DETAILED DESCRIPTION

Figure 1:
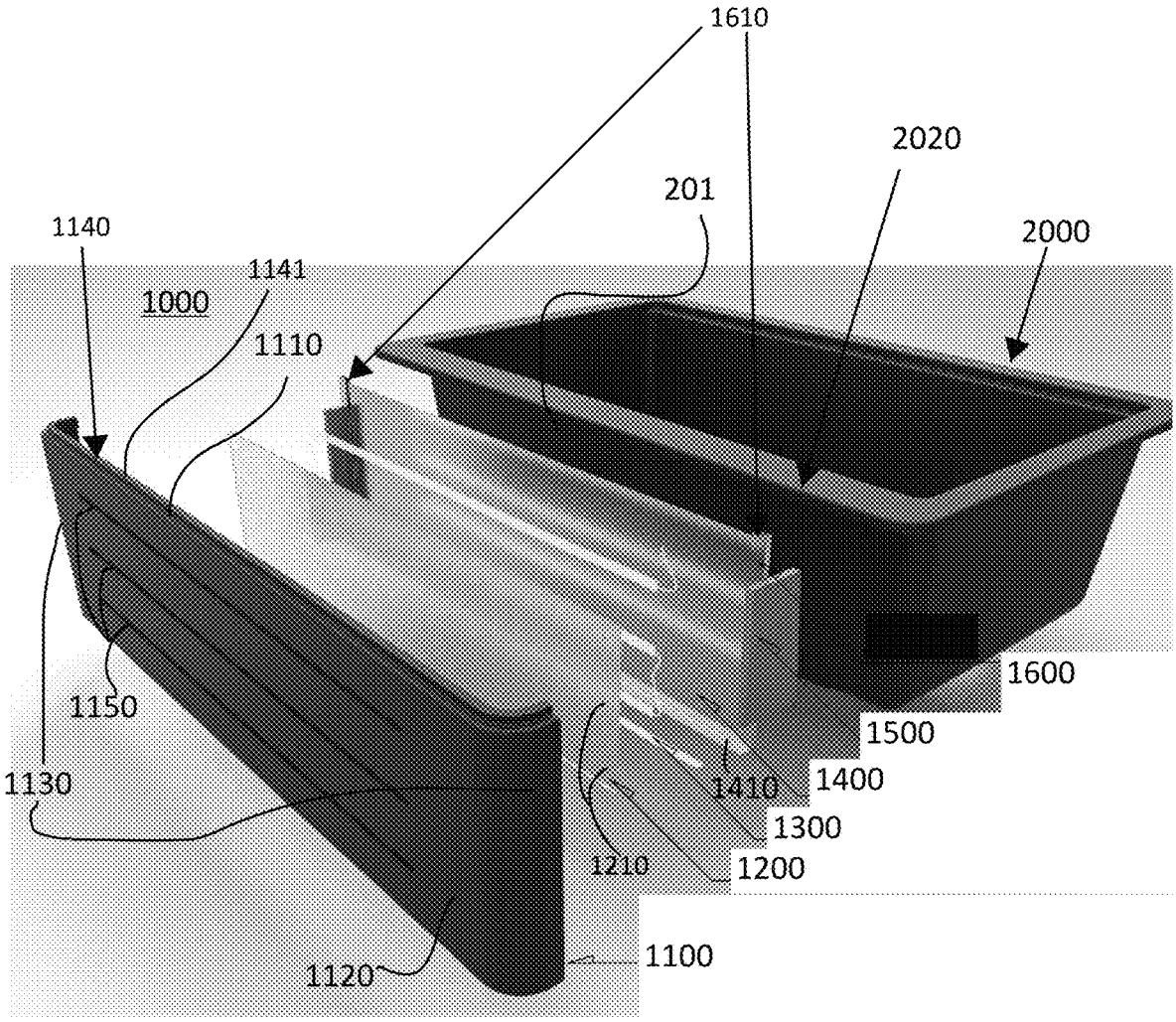
FIG. 1 is a perspective exploded view of a lighting system adjacent of a sink, according to the present disclosure.

Aspects of the disclosed system and methods associated with the lighting system for kitchen and bathroom fixtures are described in detail regarding the drawings in which like reference numerals designate identical or corresponding elements in each of the several views.

Referring now to the drawing in greater detail, FIG. 1 illustrates a lighting system 1000 incorporated into the apron portion or front portion of a sink, however, the present disclosure is not limited to a lighting system for a sink. In general, it refers to a device that can be used or mounted on other fixtures or appliances. The lighting system 1000 may be configured to operably connect to sink 2000 or may be manufactured as a non-removable element on the sink 2000. In other embodiments, the lighting system may be incorporated into any fixture or appliance to illuminate the surrounding space (e.g., bathroom cabinet, kitchen cabinet, washing machine, drying machine, fire-place).

For reasons of brevity, the lighting system 1000 will be described as directed to a kitchen or bathroom sink such as sink 2000. Besides, in selected embodiments, the lighting system 1000 may include sink 2000 as an element thereof. In general, the lighting system 1000 may be configured to operably connect to the sink 2000 and to provide illumination, and/or a desired decorative feature. The lighting system of the present disclosure may enhance the surrounding space where the sink 2000 may be disposed about.

Figure 2:
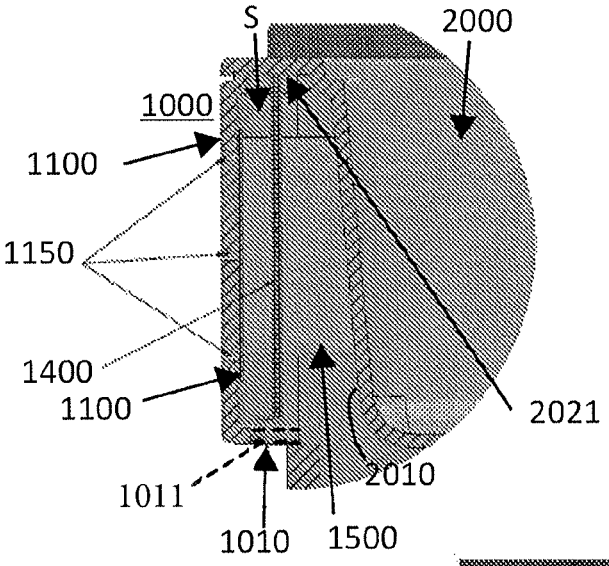
FIG. 2 is a side view of a cut view of the lighting system of FIG. 1, the lighting system is assembled and operably connected to the sink according to the present disclosure.

The lighting system 1000 can be composed of various materials, for example, a facade or apron 1100 can be manufactured using materials such as metals, plastics, composites, resins, stone, ceramics, vitreous china and/or enameled cast-iron; alone or in combination. Other materials include enameled steel, tempered glass, stone, wood, acrylic and solid surface. On the other hand, fixtures or appliances, e.g., the sink 2000, may be manufactured of a material similar to the facade 1100 or other suitable material. For example, the sink 2000 can be made of at least one material such as, but not limited to, ceramic, concrete, copper, enamel, ore, steel, cast iron, glass, granite, marble, nickel, plastic, polyester, porcelain, resin washbasin, soapstone, stainless steel, stone, terrazzo, composite materials, or wood (the facade 1100 could be manufactured with similar materials). In selected applications, the lighting system 1000 can be custom manufactured using materials similar to the materials used to manufacture the sink 2000, as mentioned above. For example, when a user decides that the lighting system 1000 should match the sink 2000, the lighting system 1000 (or a portion or element thereof) and the sink 2000 may be made of the same composite material, and even further, may be painted the same color. When connected to a fixture (e.g. sink 2000) or when monolithically formed with a fixture, the lighting system 1000 may define an opening 1010 (FIG. 2) which may enable manipulation of the elements disposed between the apron 1100 and the kitchen sink 2000 (e.g. extraction of the LED strip 1300 and/or the sheet metal panel 1400). Further, the opening 1010 is configured as an light-outlet-port. For example, selected embodiments may further include a cap 1011 (FIG. 2) that can operably connect to the lighting system 1000 about the opening 1010 while allowing passing of light therethrough. In another example, there may be no cap 1011, and light passes through the opening 1010.

The method used to attach the lighting system 1000 to the sink 2000 may vary depending on the material and/or the application. For example, as shown inf FIG. 1, the lighting system 1000 is connected to the sink 2000 via fasteners (e.g. epoxy, screws), some structural elements which will be described further in detail hereinbelow may be connected in a similar way.

In the exemplary embodiment of FIG. 1, the lighting system 1000 is shown including a façade or apron 1100, a translucent plastic panel 1200, LED strips 1300, an L-folded sheet metal panel 1400, a pair of reinforcements 1500, and C-profiles 1600. However, in selected embodiments some of these elements can be optional; for example, the L-folded sheet metal panel 1400, the pair of reinforcements 1500, and the C-profiles 1600 may be replaced by mounting elements (not shown) connecting the lighting system 1000 to the sink 2000. In another example, the sink 2000 may include protrusions (not shown) extending away from the sink 2000 which may be configured to connect to the apron lighting system 1000; these protrusions (not shown) can replace reinforcements 1500. In another embodiment, the lighting system 1000 may include hooking elements (not shown) which are configured to extend away from the apron 1100 and connect to the sink 2000, while sandwiching (or securing in between) controls, illumination elements, and other desired components between the apron 1100 and a selected surface of the sink 2000 (e.g. sink surface 2010 (FIG. 2)). Alternatively, these hooking elements (not shown) may extend away from sink 2000.

The apron 1100 of the lighting system 1000 includes an apron body 1110 having a flat rectangular portion 1120 with a pair of curved ends 1130. Further, the apron 1100 includes a C-like-elongated cross-sectional profile 1140 and at least one opening 1150. For example, as shown in FIG. 1, the apron 1100 includes three openings 1150 which are elongated and disposed trough the flat rectangular portion 1120 and each is disposed parallel one to another. In addition, as shown in FIG. 1, the at least one opening 1150 are disposed parallel and to lip 1141. In other embodiments, the at least one opening may be configured into any desired shape such as circular, square, triangular, oval, or any other shape known in the art to customize the illumination experience. In selected embodiments, the flat rectangular portion 1120 (hereafter flat portion 1120) can have a different shape, e.g., rhomboidal, circular, square, triangular, oval, or any other shape known in the art, depending on the desired application, while including a cross-sectional profile 1140 which may be C-like or another suitable shape (e.g. triangular, rhomboidal, squared).

The translucent plastic panel 1200 of the lighting system 1000 can be rectangular, as show, and is generally disposed between the apron 1100 and the LED strips 1300. As shown, the translucent plastic panel 1200 is slightly smaller in size when compared to the flat portion 1120 of the apron 1100 and is disposed in such a way that, when assembled, covers the openings 1150. The plastic panel 1200 is fastened to the apron 1100. For example, the plastic panel 1200 may be glued (e.g. epoxy) or bolted to the apron 1100. In another embodiment, the plastic panel 1200 may be press-fitted between the pair of reinforcements 1500. Alternatively, the plastic panel 1200 may include openings such as openings 1210 and configured to receive tabs (not shown) protruding away from the apron 1100. The plastic panel 1200 is configured to allow some light to travel therethrough. For example, the plastic panel 1200 can be manufactured of materials like frosted glass and some plastics, which may be translucent or transparent. When light strikes the plastic panel 1200, only some of the light passes through them. The light does not pass directly through the materials. For example, in FIG. 1, the plastic panel 1200 is configured to enable the passing of light emitted from the LED strips 1300; the light emitted from the LED strips 1300 ultimately passes through the openings 1150 and is described in more detail hereinbelow. In embodiments, the translucent plastic panel 1200 may be configured to allow passing of light, for example, the translucent plastic panel 1200 may be an acrylic diffuser which can be substantially translucid (or clear), have a color, or have a selected design or pattern. Furthermore, the translucent plastic panel 1200 may be UV resistant and may have break resistant features, yet easy to cut-to-size. Further in embodiments, the plastic panel 1200 may be an acrylic prismatic panel or a combination of an acrylic prismatic panel and a non-prismatic panel. In other words, the translucent plastic panel 1200 can be a panel having a section with a pattern and a substantially flat section. Alternatively, the translucent plastic panel 1200 may be configured as an egg crate light panel with an open cell panel. Such a design, similar to an open-cell design (or honeycomb), may allow for free air circulation resulting in lower operating temperatures of the LED strip 1300 (or ballast), which ultimately may increase the life and performance of the LED strip 1300. Alternatively, the translucent plastic panel 1200 may be a polycarbonate plastic or panel having a combination of polycarbonate plastic and acrylic. In selected applications, the translucent plastic panel 1200 may include a combination of polymers of a selected tone and/or color, e.g. acrylic clear and acrylic white.

The LED strips 1300 of the lighting system 1000 are configured to emit light which will ultimately pass through the plastic panel 1200 and the openings 1500 which are disposed onto the flat portion 1120 of the apron 1100. The LED strips 1300 may correspond in size and/or shape (or may be about the same size) when compared to the openings 1150. For reasons of brevity the LED strips 1300 are described in view of FIG. 1, wherein such a configuration includes four LED strips 1300. In general, the lighting system 1000 can include any selected number of LED strips, which may fit in a space "S" (FIG. 2) define between the plastic panel 1200 and apron 1100. The LED strips 1300 are elongated strips which include one or a plurality of LEDs (LED strips are known in the art, thus, will not be described in detail herein). The LED strips 1300 may have a light temperature selected between about 2200 to about 6500 degrees Kelvin and may operate between about 2 Watts to about 15 Watts, however these are not limiting parameters. For example, the color of the LED strips 1300 may be selected from warm white (about 2700K), soft white glow (about 2000K), daylight glow (about 4000K), and/or crystal white glow (about 5000 k). In selected applications, the combination of lights, associated with the LED strips 1300, of changing colors temperature or steady colors changing tone (e.g., red, blue, green, yellow) may be possible. As shown, three of the LED strips 1300 are disposed in correspondence with each opening 1150 of the apron 1100 but slightly higher relative to the openings 1150 (or lower, if desired). The remaining LED strip 1300 is connected to a portion of the L-folded sheet metal panel 1400 (e.g. L-fold 1410) and is configured to provide illumination in a direction away from the apron 1100, e.g., in such a way that illuminates the bottom of the apron 1100 and a surface (not shown) disposed below the apron 1100. However, the number of LED strips 1300, the position of the LED strips 1300, and even the type of light fixture may vary depending on the application. For example, the lighting system 1000 may include a single LED strip 1300 which can be configured to emit light in multiple directions and away from the apron 1100. In another example, the shape of the LED strips 1300 may be circular. In some applications, where the number of openings 1150 may vary, the number of LED strips 1300 may correspond the number of openings 1150. Additionally, the LED strips 1300 shape can correspond the shape of openings 1150. For example, the LED strip 1300 may be a circular LED strip or lamp (not shown) configured accordingly and to correspond to an opening 1150 having a circular shape. In another example, the LED strips 1300 may be replaced by light(s) selected from incandescent lamp(s), compact fluorescent lamp(s), halogen lamp(s), metal halide lamp(s), fluorescent tube(s), neon lamp(s), high intensity discharge lamp(s), low pressure sodium lamp(s), or other source(s) illumination. In selected embodiments, the LED strips 1300 may be ultimately controlled via a mobile device, e.g., a smart phone or other type of personal computer. In alternative embodiments, the LED strips 1300 may be disposed about sink lip 2020 (FIG. 1), e.g. operably connected to portion 2021 (FIG. 2) of the sink lip 2020. Alternatively, or in addition, the LED strips 1300 may be disposed about sink bowl 2030 (FIG. 3), e.g., operably connected to a side 2031 of sink 2031 or a divider (not shown) which can be disposed centrally in the sink bowl 2030.

The lighting system 1000 may include a voltage LED control unit 1700 (FIG. 4) associated with the manipulation and/or operation of LED strips 1300. Control unit 1700 is generally disposed underneath the sink 2000, however the position of the voltage LED control unit 1700 may vary depending of the application. The voltage LED control unit 1700 is a low voltage LED control unit and it may be pairable (or it may come pre-paired) with a wireless control (e.g. wireless RBG LED Dimmer, remote control with buttons; some embodiments having Bluetooth and/or Wi-Fi enabling technology and may further offer pairing with some proprietary home systems, e.g., Amazon Alexa and/or Google Home) or may be operably connected to a non-wireless controller. The wireless controller (not shown) or the non-wireless controller (not shown) may enable color changing and/or illumination intensity of the LED strips 1300. Further, the wireless controller (not shown) or the non-wireless controller (not shown) may enable control of the way the light is emitted, for example, the light may be emitted in a pattern (e.g., the LED strips 1300 may be configured to change color, stay on the same color for a selected time, to emit intermittent light, or to slowly dim illumination following a selected loop configuration). In addition, the wireless controller (not shown) or the non-wireless controller (not shown), when paired to a receiver (not shown) that can be connect to the LED strips, may control or enable additional features such as operation of the LED strips 1300 (e.g., turning on or off the lights) via the push of a button (not shown) or a voice command. The LED strips 1300 may be powered directly from a wall socket connected to a power source (AC or DC, pending on the configuration) via a power supply (not shown) Alternatively, the LED strips 1300 may be connected to an external power source (e.g., battery). The LED strips 1300 and the power source (not shown) are ultimately connected via a power cable (not shown). When more than one LED strip 1300 are present, electrical cables (not shown) may connect the LED strips 1300 one to another and this connection may be an electrical connection known in the art as in connection in series or connection in parallel. In embodiments, the LED strips 1300 may be one LED strip 1300 disposed in such a way that may form a pattern (not shown) including substantially rectangular sections, for example an S pattern with at least three flat sections. In addition, the LED strip 1300 may be disposed vertically, e.g., if the openings 1150 are vertically oriented cutouts the LED strip 1300 may be disposed vertically to match the direction of the cutouts. In other words, in selected applications the location and direction of the LED strip 1300 may depend (or correspond to) the location and direction of the openings 1150.

In the event of LED strips 1300 maintenance, the user must disconnect the power cable(s) from the low voltage LED control unit 1700 and remove the translucent plastic panel 1200 which may be connected via a pin connector, e.g., a four pin connector quick connect. Alternatively, or additionally, a panel (not shown) may need to be removed. This panel (not shown) may be disposed between the apron 1100 and the front door of a cabinet located under the lighting system 1000 (e.g. a cabinet under an apron front sink or farmhouse style sink). As shown, the LED strips 1300 are attached to the L-folded sheet metal panel 1400. However, in systems including the sink 2000, the LED strips 1300 may be connected directly to the sink 2000 where for this kind of system the L-folded sheet metal panel 1400 may be an optional element of the system.

Figure 3:
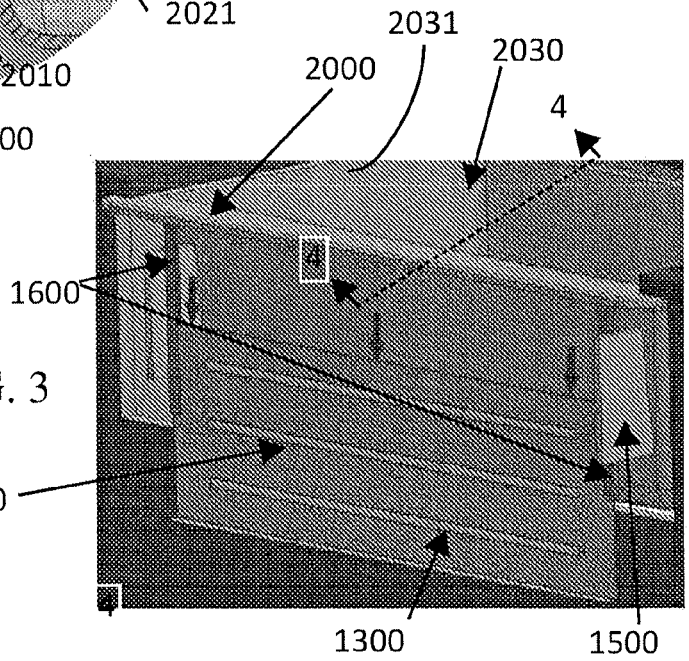
FIG. 3 is a perspective view of a lighting system connected to a panel which is sliding away from a pair of profiles connected to the sink, with the outermost apron removed, all according to FIG. 1 and the present disclosure.
Figure 4:
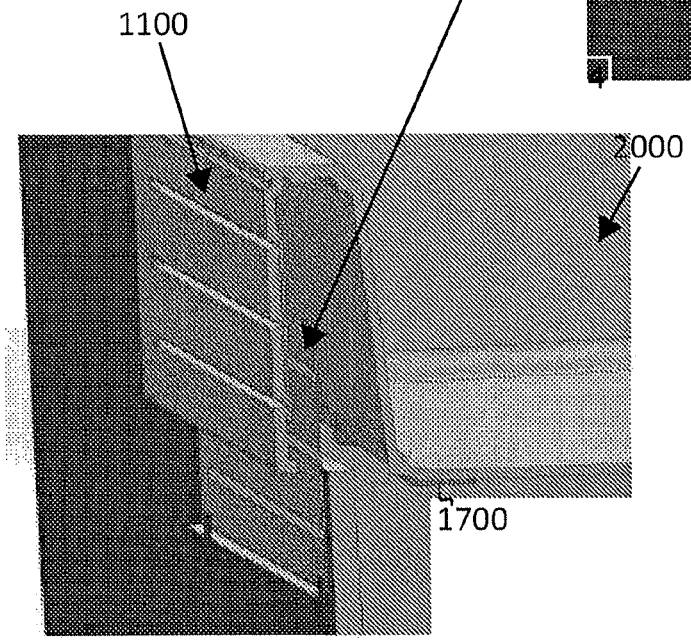
FIG. 4 is a perspective view of a cut view according to line 4-4 in FIG. 3 and the present disclosure.

The sheet metal panel 1400 of the lighting system 1000 can have an L-shaped like configuration and can be made of sheet metal. As shown in FIG. 1, and for reasons of clarity, the sheet metal panel 1400 will be described as an L-shaped metal sheet; however, this may vary depending on the application. For example, the L-folded sheet metal panel 1400 may be rectangular. In another example, the L-folded sheet metal panel 1400 may be made out of plastic or a composite (in contrast to metal) with or without a reflective surface. In selected embodiments, the sheet metal panel 1400 may be made of wood, plastic, or other suitable material and may be further coated with a reflective substrate or alternatively wrapped with a reflective material (e.g. a sheet of aluminum foil). The sheet metal panel 1400 is configured to move relative or to be operably coupled to a mounting element (e.g. C-profiles 1600, which are described further in detail). As shown, the sheet metal panel 1400 slides away from C-profiles 1600, as seen in FIGS. 3 and 4.

Still with reference to the L-folded sheet metal panel 1400, the L-folded sheet metal panel 1400 is configured as a removable panel which can be pulled away and/or disconnected from the lighting system 1000 (e.g., pulled up or down, relative to the apron 1100; in a direction perpendicular to the openings 1150), thus, making the L-folded sheet metal panel 1400 a slidable element operably connected to the pair of reinforcements 1500. The L-folded sheet metal panel 1400 has a thickness of about 3 mm to about 5 mm however, this thickness may vary depending on the application, e.g., the L-folded sheet metal panel 1400 may include a thickness of more than 5 mm or less than 3 mm, thus, the thickness may not be a limiting factor. In embodiments where the L-folded sheet metal panel 1400 is thin and/or for instances when deflection of the L-folded sheet metal panel 1400 is unwanted, the lighting system 1000 may further include elements that may aid or facility reduction of resiliency of the L-folded sheet metal panel 1400, for example, the pair of reinforcements 1500 and the C-profiles 1600, are described in more detail below. In embodiments, the L-folded sheet metal panel may be a mesh or a flat sheet metal.

In selected configurations, the pair of reinforcements 1500 of the lighting system 1000 can be optional elements. As shown, the reinforcements 1500 are generally configured to connect or abut against the apron 1100 and/or the sink 200, thus, the pair of reinforcements 1500 are generally disposed between the apron 1100 and the sink 2000. The position of the pair of reinforcements 1500 can vary depending on the application. As shown in FIG. 1, the pair of reinforcements 1500 have a substantially rectangular shape and are connected to the C-profiles 1600. The connection between the pair of reinforcements 1500 and the C-profiles 1600 can be achieved via known fasting methods, for example, gluing one element to another. In another example, bolting or screwing one element to another via a fastener (e.g., screw, hook and loop fastener, welding).

The C-profiles 1600 is a pair of elongated bars-like with each profile having a C-channel 1610 disposed along their length. As shown in FIG. 1, the C-channel 1610 is configured to receive a portion of the L-folded sheet metal panel 1400. During assembly, each C-profile 1600 receives opposite sides of the L-folded sheet metal panel 1400 which do not have the L-fold 1410 or are opposed to the L-fold 1410. The size of the C-profiles 1600 is substantially corresponding to the distance between the side having the L-fold 1410 and the side opposing the L-fold 1410.

Persons skilled in the art will understand that the devices and methods specifically described herein and illustrated in the accompanying drawings are non-limiting exemplary aspects. It is envisioned that the elements and features illustrated or described in connection with the exemplary aspects may be combined with the elements and features of another without departing from the scope of the disclosure. As well, one skilled in the art will appreciate further features and advantages of the disclosure based on the above-described aspects. Accordingly, the disclosure is not to be limited by what has been particularly shown and described, except as indicated by the appended claims.

What is claimed is:

1. A lighting system for sinks comprising:

a removable façade configured to releasably couple to a sink, the removable façade including:

an outermost apron including a rectangular portion, a plurality of openings extending through the rectangular portion, each of the plurality of openings being elongated, and spaced apart from and extending parallel to other ones of the plurality of openings;

a first panel being translucent to enable the passing of light, the first panel connected to the outermost apron or an at least one reinforcement element, the at least one reinforcement element is configured to connect to the sink and the removable façade;

wherein the at least one reinforcement element includes spaced apart first and second reinforcement elements configured to abut against the sink;

and a plurality of light sources configured to emit light which can pass through the first panel and the plurality of openings of the outermost apron, wherein the plurality of light sources are connected to a second panel, and each of the plurality of light sources is associated with a different one of the plurality of openings;

wherein opposite sides of the second panel are operably connected to the first and second reinforcement elements for releasably coupling the second panel to the sink.

2. The lighting system according to claim 1, further including at least one profile configured to slidably receive at least one of the opposite sides of the second panel and to connect to the at least one reinforcement element or the sink.

3. The lighting system according to claim 2, wherein the outermost apron defines at least a C-shape profile.

4. The lighting system according to claim 2, wherein the second panel is configured to slide relative to the at least one profile.

5. The lighting system according to claim 1, wherein the at least one light source is a LED strip.

6. The lighting system according to claim 1, wherein the at least one light source is fastened to the second panel via epoxy.

7. The lighting system according to claim 1, wherein the second panel is a flat sheet panel or a flat sheet panel with an L-fold.

8. The lighting system according to claim 1, wherein the light source is configured to emit light through a downwardly facing opening defined between the outermost apron and second panel or the sink.

9. The lighting system according to claim 1, wherein the outermost apron defines two ends configured to connect to the sink.

10. The lighting system according to claim 1, further including a cap configured to enable the passing of light and configured to operably connect to the apron or the sink, the cap being disposed between the apron and the sink, below the sheet panel.

11. The lighting system according to claim 1, wherein the second panel is a sheet metal panel.

12. A method for illuminating a fixture comprising:

providing an apron defining an interior space and having at least one opening configured to allow the passing of light coming from an interiorly disposed light source;

providing a first panel, second panel, at least one reinforcement, and a light source, all disposed about the interior space;

connecting the first panel to the apron in such a way that the first panel allows the passing of light coming from the light source through the at least one opening of the apron;

connecting at least one reinforcement element to the apron or the first panel or the fixture;

connecting at least one profile to the at least one reinforcement in such a way that enables operably connection of the second panel to thereof;

fastening the at least one reinforcement to the fixture and the apron while defining an access opening and a space between the apron and the fixture, wherein the access opening and the interior space are connected;

fastening the light source to the second panel;

inserting the second panel through the opening into the interior space, between the apron and the fixture;

operably connecting the second panel to the at least one profile; and powering the light source to activate passing of light through the first panel, the at least one opening, and the access opening.

13. The method according to claim 12, further including fastening, via epoxy, the apron to the at least one reinforcement and the at least one reinforcement to the fixture.

14. The method according to claim 12, further comprising sliding the second panel away from the at least one profile to service the LED strip.

15. The method according to claim 12, further comprising connecting the light source to a receiver and connecting, wirelessly-pairing or via a wire, the receiver to a device selected from desktop computer, smartphone, or remote controller.

* * * * *